US007311377B2

(12) United States Patent
Takagi

(10) Patent No.: US 7,311,377 B2
(45) Date of Patent: Dec. 25, 2007

(54) INKJET PRINTER

(75) Inventor: Osamu Takagi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 264 days.

(21) Appl. No.: 10/948,221

(22) Filed: Sep. 24, 2004

(65) Prior Publication Data

US 2005/0068365 A1 Mar. 31, 2005

(30) Foreign Application Priority Data

Sep. 26, 2003 (JP) ..... 2003-335076

(51) Int. Cl.
*B41J 2/165* (2006.01)
*B41J 2/155* (2006.01)

(52) U.S. Cl. ..... 347/33; 347/32; 347/42

(58) Field of Classification Search ..... 347/20, 347/22, 24, 13, 28–33, 42
See application file for complete search history.

(56) References Cited

U.S. PATENT DOCUMENTS

| | | | |
|---|---|---|---|
| 5,357,275 | A | 10/1994 | Ikado et al. |
| 5,798,775 | A | 8/1998 | Takahashi et al. |
| 6,217,146 | B1 | 4/2001 | Takahashi et al. |
| 6,435,649 | B2 | 8/2002 | Takahashi et al. |
| 6,578,945 | B2 | 6/2003 | Hashi et al. |
| 2002/0044168 | A1 | 4/2002 | Hashi et al. |

FOREIGN PATENT DOCUMENTS

| | | |
|---|---|---|
| EP | 0 494 693 A | 7/1992 |
| JP | A-03-136854 | 6/1991 |
| JP | A 03-293151 | 12/1991 |
| JP | A 04-037556 | 2/1992 |
| JP | A 04-247957 | 9/1992 |
| JP | A 06-000962 | 1/1994 |
| JP | A 07-017060 | 1/1995 |
| JP | A-10-095114 | 4/1998 |
| JP | A-2000-094714 | 4/2000 |
| JP | A 2000-263800 | 9/2000 |

(Continued)

OTHER PUBLICATIONS

U.S. Appl. No. 10/950,457, filed Sep. 28, 2004, Osamu Takagi.

*Primary Examiner*—Shih-Wen Hsieh
(74) *Attorney, Agent, or Firm*—Oliff & Berridge, PLC

(57) ABSTRACT

An inkjet printer includes a recording head, a spacer, a wiping member, a first ink absorbing member, and an ink releasing member. The recording head includes an ejection surface in which a plurality of ejection ports for ejecting ink are defined. The ejection surface faces a medium transport path. The spacer is disposed in a periphery of the recording head and includes a facing surface, which faces the medium transport path. The wiping member wipes the ejection surface. The first ink absorbing member that is disposed a gap between the ejection surface and the spacer and absorbs ink flowing into the gap between the recording head and the spacer when the wiping member wipes the ejection surface. The ink releasing member is connected to the first ink absorbing member and discharges the ink absorbed by the first ink absorbing member from the gap between the ejection surface and the spacer.

27 Claims, 7 Drawing Sheets

FOREIGN PATENT DOCUMENTS

| | | |
|---|---|---|
| JP | A-2002-120386 | 4/2002 |
| JP | A 2002-120386 | 4/2002 |
| JP | A 2002-240308 | 8/2002 |
| JP | A-2003-001855 | 1/2003 |
| JP | A 2003-127436 | 5/2003 |

INKJET PRINTER

BACKGROUND OF THE INVENTION

1. Field of the Invention

The present invention relates to a wiping technique of wiping away ink adhering to a recording head in an ink-jet printer that ejects ink from nozzles of the recording head onto a printing medium to form an image.

2. Description of the Related Art

Inkjet printers that ejects small ink droplets from plural nozzles disposed in a recording head to conduct a printing operation are classified into a so-called serial head printer and a so-called line head printer. The serial head printers conduct a printing operation by a combination of a moving operation in a main scanning direction (the width direction of a sheet) in which ink is ejected while moving the recording head in the main scanning direction, and an operation in which the sheet is moved in a sub-scanning direction. The line head printers include a line head having a printing width that is equal to the width of a sheet functioning as a printing medium, and conduct a printing operation while relatively moving the line head and the sheet. In a line head printer, particularly, it is not required to move a recording head in the main scanning direction of a sheet. Hence, the printing speed can be made higher than that in a serial head printer.

In both the serial head printer and the line head printer according to the related art, in order to obtain an image of excellent quality, ink ejection from minute nozzles disposed in the recording head must be kept in satisfactory condition. Therefore, a wiping operation is conducted to wipe an ejection surface where ink ejection ports of the nozzles are disposed, thereby removing excess ink droplets or foreign matters adhering to the ejection surface.

The serial head printer described above has a structure in which the recording head can be moved in the main scanning direction. Therefore, a wiping operation can be conducted after the recording head is retracted to a region, which is on an extended line in the main scanning direction and is outside the printing region.

However, an ink jet head of the line head type has an ink ejection surface, which is larger than that of an ink jet head of the serial head type. When a printer is configured so that such a recording head is horizontally moved to a region outside the printing region and a wiping operation is then conducted, the size of the printer is inevitably increased. Therefore, in a line head inkjet printer according to the related art, a maintenance unit, which conducts a wiping operation, is inserted between the ink jet head and a medium transporting apparatus while a recording head is kept to be horizontally fixed, and a wiping operation is then conducted.

JP-A-2003-1855 (pages 10-12; and FIG. 20) discloses a line head inkjet printer in which ink absorbing members are disposed between plural recording heads, so that after an ejection surface of one of the recording heads is wiped, ink adhering to a wiper is prevented from adhering to another recording head to be next wiped by the wiper, thereby eliminating color mixture.

SUMMARY OF THE INVENTION

In the related art, ink, which adheres to a wiper during a wiping operation, is wiped away by the ink absorbing members. However, there is the possibility that part of the ink adhering to the wiper may flow into the periphery of the recording head during the wiping operation, and thus remains in the periphery of the recording head. The ink remaining in the periphery of the recording head causes problems in that it drips on a transporting apparatus or a sheet, and that it flows from a portion where the recording head is mounted to the interior of the recording head.

The invention provides an inkjet printer that can solve the above-discussed problems, and in which, when an ink adhering to a wiper during a wiping operation flows into the periphery of a recording head, the ink can be adequately discharged, and the ink adhering to the wiper can be suitably removed away, whereby a recording sheet and a transporting apparatus are prevented from being contaminated.

(1) In order to solve the problems, according to one embodiment of the invention, an inkjet printer includes a recording head, a spacer, a wiping member, a first ink absorbing member, and an ink releasing member. The recording head includes an ejection surface in which a plurality of ejection ports for ejecting ink are defined. The ejection surface faces a medium transport path. The spacer is disposed in a periphery of the recording head and includes a facing surface, which faces the medium transport path. The wiping member wipes the ejection surface. The first ink absorbing member that is disposed a gap between the ejection surface and the spacer and absorbs ink flowing into the gap between the recording head and the spacer when the wiping member wipes the ejection surface. The ink releasing member is connected to the first ink absorbing member and discharges the ink absorbed by the first ink absorbing member from the gap between the ejection surface and the spacer.

According to one embodiment of the invention, even when ink flows to the periphery of the recording head during a wiping operation to remain therein, the ink can be suitably removed away. Accordingly, a transporting apparatus and/or a sheet can be prevented from being contaminated.

DETAILED DESCRIPTION OF THE PREFERRED EMBODIMENT

Embodiment 1

Hereinafter, an embodiment of the invention will be described with reference to the accompanying drawings.

First, main portions of an inkjet printer of the embodiment 1 of the invention will be described with reference to FIG.

Figure 1:
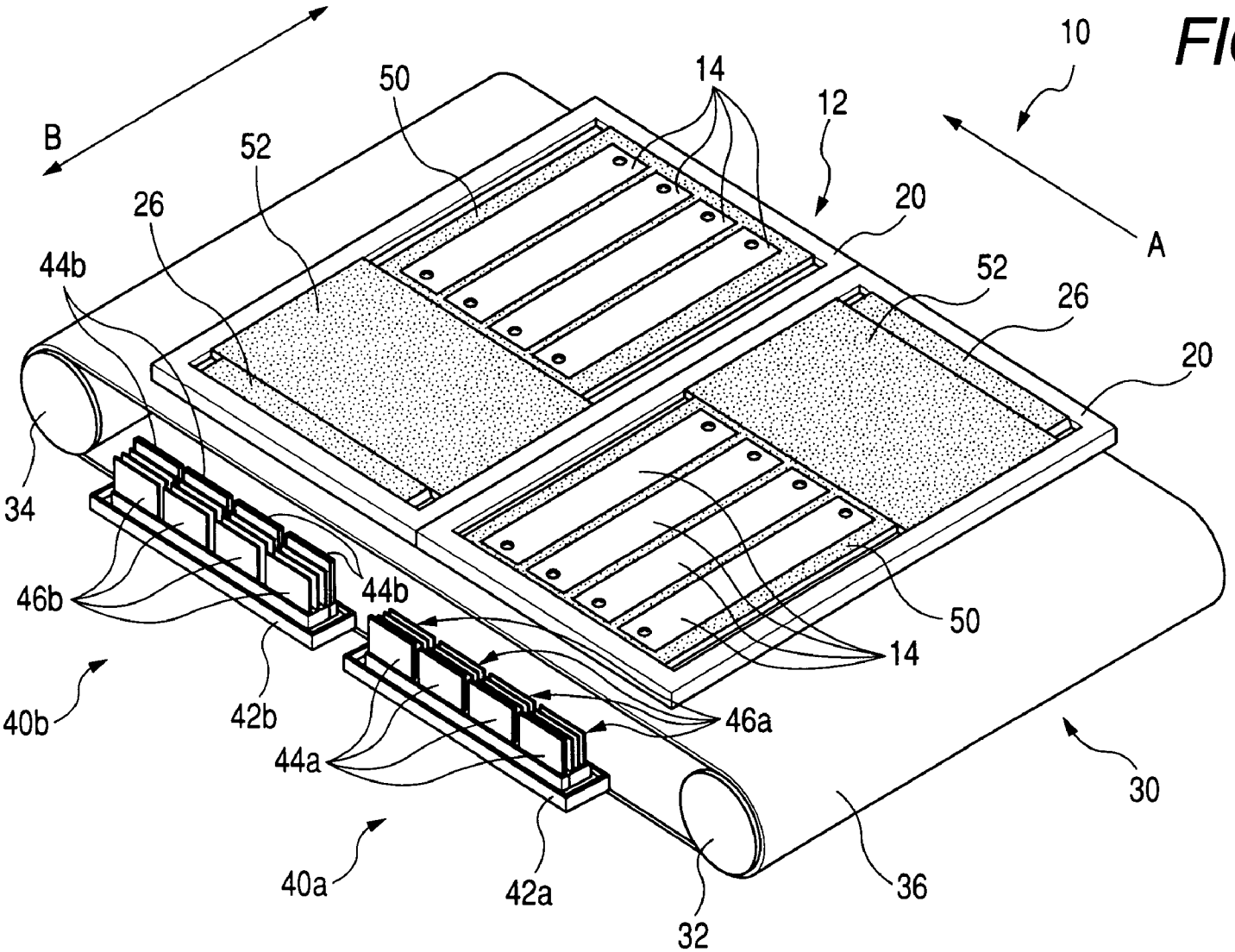
FIG. 1 is a perspective view schematically showing main portions of an inkjet printer 10.

1. FIG. 1 is a perspective view schematically showing the main portions of the inkjet printer 10 of the embodiment 1.

The inkjet printer 10 shown in FIG. 1 is a color ink-jet printer of the line head type having eight line-type recording heads 14 as an image forming portion 12. Namely, the printer 10 is a line-printing type inkjet printer in which, during a printing operation, the recording heads 14 are positionally fixed and form an image on a sheet transported by a transport unit 30.

Among the eight recording heads 14, four heads are attached to each of two head holders 20 so as to be arranged in a medium transporting direction (a direction of the arrow A in FIG. 1) as viewed in a direction (a direction of the arrow B in FIG. 1, and hereinafter referred to as the width direction) perpendicular to the medium transporting direction.

The inkjet printer 10 is configured so that a printing operation for one line of one of four colors (yellow (Y), magenta (M), cyan (C), and black (K)) in the width direction of a sheet is conducted by using two of the recording heads 14. Specifically, the eight recording heads 14 are divided into four groups in each of which inks of the same color are to be ejected, and the recording heads 14 of the same group are fixed so as to partly overlap with each other as viewed in the medium transporting direction.

Each of the recording heads 14 has a flow path unit in which ink flow paths each including a pressure chamber are formed; and an actuator unit, which pressurizes ink in each of the pressure chambers. Many ejection ports 18 (see FIG. 3) of a small diameter corresponding to nozzles are disposed in rows in a bottom surface (ejection surface 16) of each recording head 14, so that when the actuator unit is driven, ink is ejected without forming gaps in the sheet width direction.

The recording heads 14 are placed so that a small gap is defined between their ejection surfaces 16 and a transport belt 36, and a sheet transport path (medium transport path) is formed in the gap. According to the configuration, when a sheet transported on the transport belt 36 is sequentially passed immediately below the eight recording heads 14, the color inks are ejected from the ejection ports 18 toward an upper face (printing face) of the sheet, whereby a desired color image is formed on the sheet.

In the inkjet printer 10, the transport unit 30 transports a sheet supplied from a sheet supply unit (not shown) so that the sheet passes below the recording heads 14, is subjected to an image forming process, and then discharged to a sheet discharge unit (not shown).

The transport unit 30 has two belt rollers 32, 34, and the transport belt 36 wound around the belt rollers 32, 34. The belt roller 32 is a driving roller to which a driving force is transmitted from a transport motor (not shown) to be rotated. By contrast, the belt roller 34 is a driven roller rotated by a rotational force of the transport belt 36 that is provided by the rotation of the belt roller 32.

The transport belt 36 is an endless belt, which is made of a flexible material such as rubber and is formed into a loop-like shape. In the transport belt 36, the outer peripheral face is treated with silicon rubber so that a transported sheet can be transported by the driving of the belt roller 32 in the medium transporting direction while the sheet is held onto the outer peripheral face by adherence.

The inkjet printer 10 includes maintenance units 40*a*, 40*b* which conduct a restoring operation to maintain the ink ejection through the minute ejection ports 18 disposed in the recording heads 14 to satisfactory condition. The restoring operation is conducted at a timing such as that when an ink is initially introduced from an ink source (not shown) to one of the recording heads 14, or that when the printer 10 has not been used for a long term and the operation of the printer is then resumed. In the embodiment 1, a wiping operation of wiping away ink adhering to the ejection surfaces 16 is conducted. In addition, a purging operation of suction- (or pressure-) removing ink inside the recording heads 14 through the ejection ports 18 may be conducted. Also, when the printing operation is not conducted, a capping operation of setting the ejection surfaces 16 to a hermetically closed state may be conducted in order to prevent ink in the vicinities of the ejection ports 18 from drying.

As shown in FIG. 1, the maintenance units 40*a*, 40*b* include a frame 42*a*, 42*b*, wipers 44*a*, 44*b*, and comb-like members 46*a*, 46*b*, respectively. The maintenance units 40*a*, 40*b* can be moved in the width direction by a moving mechanism not shown. Hereinafter, the maintenance unit 40*a* will be described.

The wipers 44*a* and the comb-like members 46*a* are attached to the frame 42*a* in accordance with the recording heads of the respective colors. The wipers 44*a* are members for wiping away ink remaining on the ejection surfaces 16 of the recording heads 14, and made of polyurethane rubber having an ink resistance. The comb-like members 46*a* have a structure in which plural slender plates erect parallel to the medium transporting direction, and a small gap is formed between the plates. The levels of the upper ends of the comb-like members 46*a* are adjusted so that the upper ends can pass a position separated from the respective ejection surfaces 16 by a small distance. Among ink droplets adhering to the ejection surfaces 16, therefore, those of a relatively large size make contact with the comb-like members 46*a* to be transferred to the comb-like members 46*a*, and hence are removed away from the ejection surfaces 16. The removed ink is sucked into the gaps between the plates by capillary action to be held therein.

In order to conduct the wiping operation, the ink-jet printer 10 includes a mechanism (not shown) for vertically moving the transport unit 30 so as to form a space, which enables the maintenance units 40*a*, 40*b* to be inserted into a position where the maintenance units 40*a*, 40*b* face the ejection surfaces 16. During a printing operation and the like, the maintenance units 40*a*, 40*b* wait at a position which is separated from the transport unit 30 in the width direction. During the wiping operation, the transport unit 30 is downward moved, and the maintenance units 40*a*, 40*b* are then moved in the width direction to apply the wiping operation on the ejection surfaces 16. The mechanism for moving the transport unit 30 and the maintenance unit 40 is realized by a known technique such as JP-A-2002-120386, which is incorporated herein by reference in its entirety. Hence, its detailed description is omitted.

Each of the maintenance units 40*a*, 40*b* travels back and forth in the width direction between one and other ends of corresponding one of the head holders 20. In the forward movement, the frame 42*a* is raised so that the wipers 44*a* are in contact with the ejection surfaces 16; and the frame 42*b* of the maintenance unit 40*b* is lowered so that the wipers 44*b* are separated from the ejection surfaces 16. By contrast, in the return movement, the frame 42*b* is raised so that the wipers 44*b* are in contact with the ejection surfaces 16; and the frame 42*a* of the maintenance unit 40*a* is lowered so that the wipers 44*a* are separated from the ejection surfaces 16. Therefore, each of the wipers is configured so that, after the wiper wipes the corresponding ejection surface 16, ink adhering to the wiper is removed away by inflow holes 27 and a third ink absorbing member 26 which will be described later. Hereinafter, the direction along which each wiper wipes the corresponding ejection surface 16 is referred to as the wiping direction. Namely, the wiping direction of the maintenance unit 40*a* is oriented from the front side to the inner side in the direction of the arrow B in FIG. 1, and that of the maintenance unit 40*b* is oppositely oriented.

The maintenance units 40*a*, 40*b* are configured in the same manner except that their wiping directions are opposite to each other. Therefore, the maintenance units 40*a*, 40*b* are often referred to as the maintenance units 40, and the frames 42*a*, 42*b*, the wipers 44*a*, 44*b*, and the comb-like members 46*a*, 46*b* are often referred to as the frames 42, the wipers 44, and the comb-like members 46, respectively.

Figure 2:
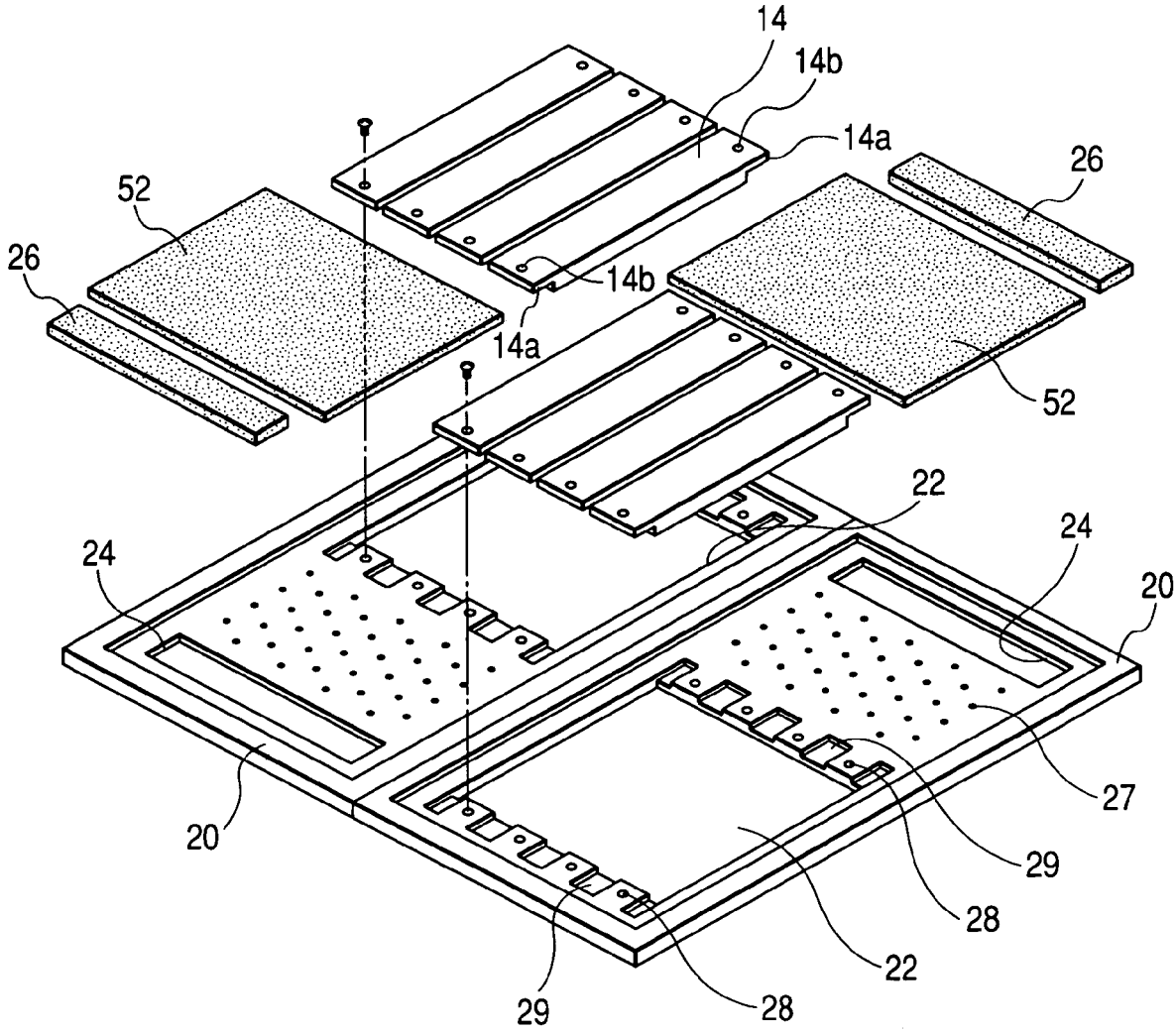
FIG. 2 is a perspective view showing the appearance of head holders 20.
Figure 3:
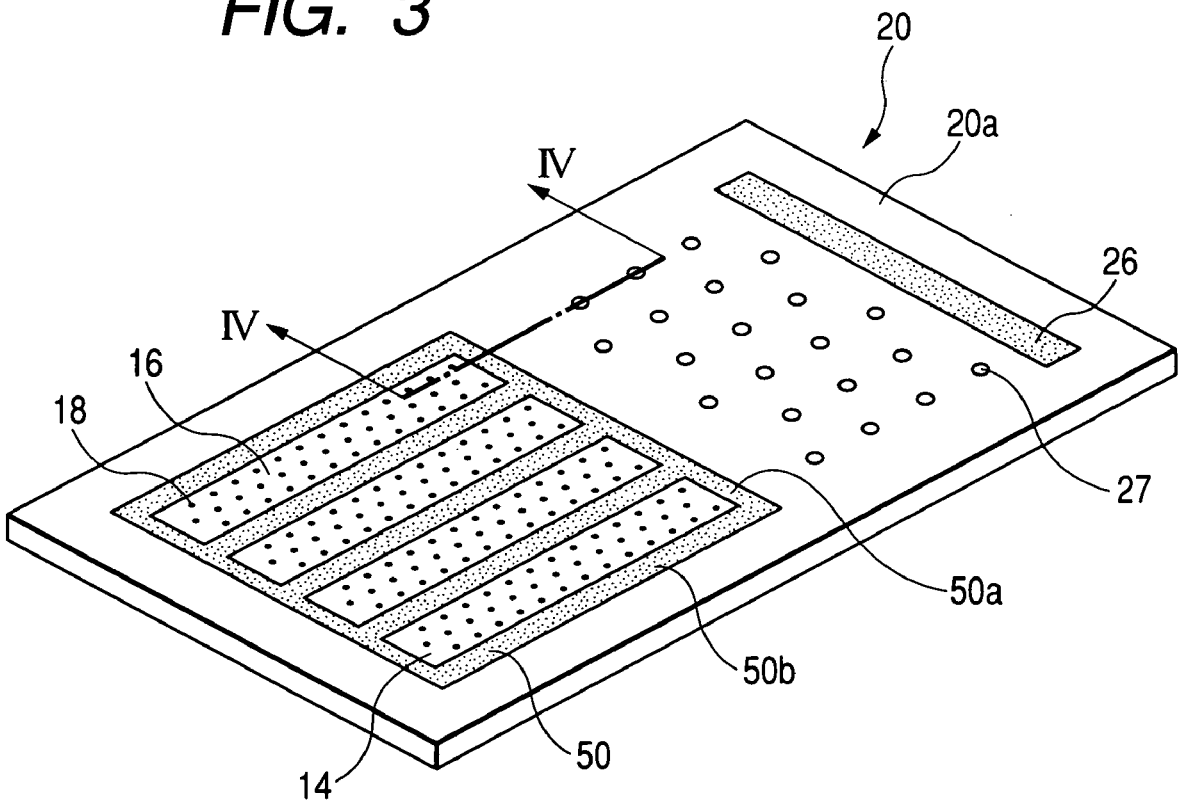
FIG. 3 is a view showing a state where recording heads 14 are attached to the head holder 20, as looking from the side of ejection surfaces 16.
Figure 4:
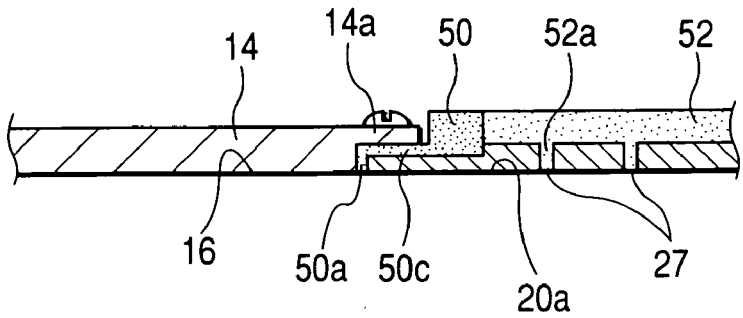
FIG. 4 is a section view taken along the line X-X in FIG. 3.
Figure 5A:
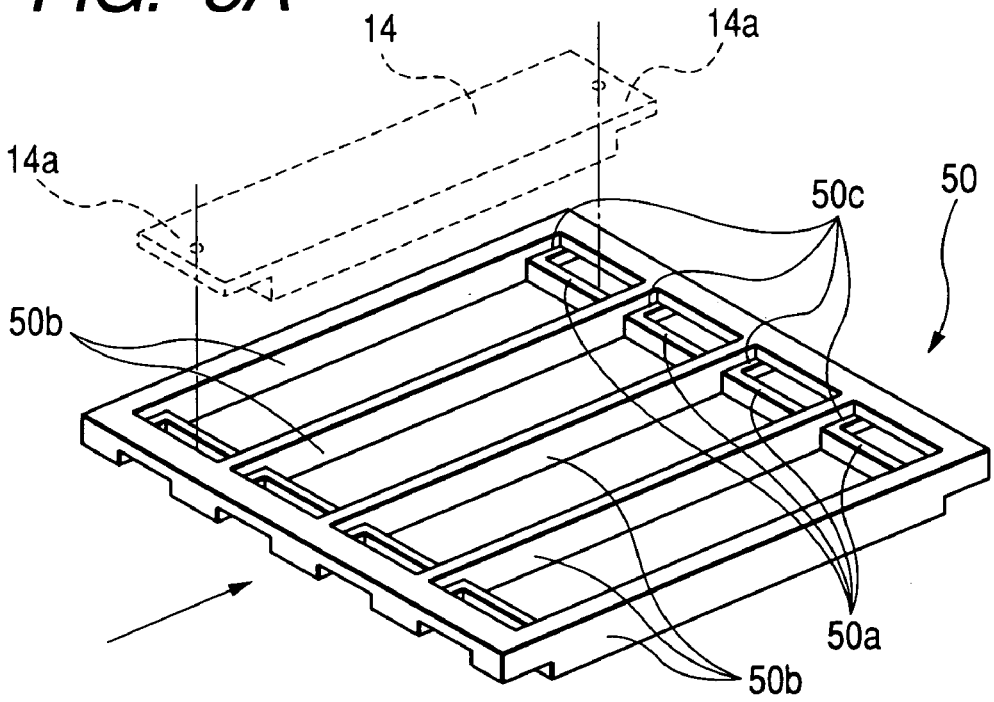
FIG. 5 is a view showing the shape of a first ink absorbing member 50.
Figure 5B:
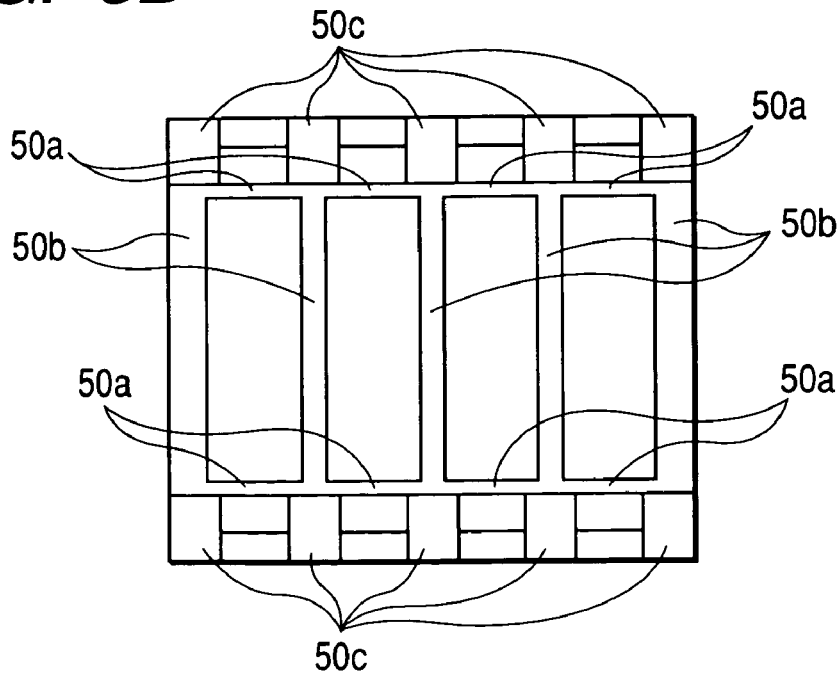

Next, the image forming portion 12 of the inkjet printer 10 will be described with reference to FIGS. 2 to 5. FIG. 2 is a perspective view showing the appearance of the head holders 20. FIG. 3 is a perspective view showing a state where the recording heads 14 are attached to the head holder 20, as viewed from the ejection surfaces 16 side. FIG. 4 is a section view taken along the line IV-IV in FIG. 3, and showing a portion where the recording head 14 is coupled to the head holder 20. FIG. 5 is a view showing the shape of a first ink absorbing member 50.

In each of the recording heads 14, as shown in FIG. 2, holding portions 14*a* and screw holes 14*b* for attaching the recording head 14 to one of the head holders 20 are provided at both ends thereof in the longitudinal direction, respectively.

The head holders 20 are members which are used for fixing the recording heads 14 and formed of an aluminum plate in which an opening 22 into which the recording heads 14 are to be fitted is defined. Four recording heads 14 can be fixed to each of the head holders 20. As shown in FIG. 1, the two head holders 20 are arranged so that the recording heads 14 partly overlap with one another when viewed in the medium transporting direction, whereby printing for one line in the sheet width direction can be conducted in a width equal to the width of a sheet. In the embodiment 1, the recording heads 14 are placed so as to be close to one another, and therefore four recording heads 14 can be fitted into one opening 22. Alternatively, an opening may be independently formed for each of the recording heads 14.

In each of the head holders 20, a placement hole 24 where the third ink absorbing member 26 (functioning as a third ink absorbing member), which absorbs ink adhering to the wipers 44 during the wiping operation is to be placed is defined. The third ink absorbing member 26 is fittingly fixed to the placement hole 24 in such a manner that a lower face of the member 26 slightly protrudes from a bottom face (facing surface 20*a*) of the head holder 20.

In the head holder 20, screw holes 28 for fixing the recording heads 14 are defined in the periphery of the opening 22. The recording heads 14 are fixed by screws while the screw holes 14*b* of the holding portions 14*a* are positionally aligned with the screw holes 28 of the head holder 20 (see FIG. 1).

As shown in FIG. 4, the facing surface 20*a* of each of the head holders 20 is designed so as to be positioned in the same level (the same plane; the same height) as the ejection surfaces 16 of the recording heads 14. Because of the configuration in which the facing surface 20*a* of the head holder 20 is in the same level as the ejection surfaces 16, a situation where a sheet is curved and raised and then the tip end of the sheet is caught by the peripheral portion (a face adjacent to the ejection surfaces 16) of the recording heads 14 to cause sheet jamming can be prevented from occurring. Namely, the head holders 20 have a function of fixing the recording heads 14, and functions also as a spacer, which eliminates a space where a sheet may be caught by the peripheral portion of the recording heads 14.

As shown in FIGS. 3 and 4, in the state where the recording heads 14 are attached to each of the head holder 20, a sponge-like first ink absorbing member 50 (functioning as a first ink absorbing member) is disposed in gaps between the recording heads 14 and the head holder 20 (functioning as the spacer). The first ink absorbing member 50 does not protrude from the ejection surfaces of the recording heads 14 and the facing surface of the head holder 20. In other words, the first ink absorbing member 50 is in the same level as the ejection surface and the facing surface or is recessed from the ejection surfaces.

As shown in FIG. 5, the first ink absorbing member 50 is formed by first ink absorbing portions 50*a*, second ink absorbing portions 50*b*, and ink releasing portions 50*c*. The first ink absorbing portions 50*a* are inserted into gaps between the recording heads 14 and the head holders 20 on upstream and downstream sides of the recording heads 14 in the wiping direction. The second ink absorbing portions 50*b* are inserted into gaps between the recording heads 14, which are adjacent to each other in the medium transporting direction, or between the recording heads 14 and the head holders 20.

The first and second ink absorbing portions 50*a*, 50*b* of the first ink absorbing member 50 absorb ink flowing into the gaps between the recording heads 14 and the head holders 20 when the wipers wipe the ejection surfaces 16. The ink releasing portions 50*c* discharge the ink absorbed by the first and second ink absorbing portions 50*a*, 50*b*, through the gaps formed in the peripheries of the recording heads 14, and are integrally formed as a part of the first ink absorbing member 50.

As shown in FIG. 4, the ink absorbed by the first ink absorbing member 50 is sucked through the ink releasing portions 50*c* into a second ink absorbing member 52, which is disposed on a side opposite to the facing surface 20*a* of the head holder 20. An ink discharging mechanism, which is formed of a sponge member and is not shown, is disposed in the second ink absorbing member 52. The ink absorbed by the second ink absorbing member 52 is discharged through the ink discharging mechanism into a waste ink reservoir.

In each of the head holders 20, as shown in FIG. 2, placement grooves 29 communicating the gaps between the recording heads 14 and the head holder 20 with the space (the upper face of the head holder 20) where the second ink absorbing member 52 is placed are defined at positions separated from the fixing positions (the positions of the screw holes 28) of the screws (functioning as fixing members), which fix the recording heads 14.

Each of the recording heads 14 is fixed to the head holder 20 by the screws. The position of the recording head 14 in a direction perpendicular to the ejection surface 16 of the recording head 14 affects the ink printing accuracy, and hence the degree of screw-fastening the recording heads 14 must be correctly adjusted. If a soft member such as the ink releasing portions 50*c* exists at the fixing positions of the recording heads 14 to be interposed between the recording heads 14 and the head holder 20, however, the screw fastening cannot be correctly conducted.

In the embodiment 1, therefore, the ink releasing portions 50*c* are fitted into the placement grooves 29, thereby enabling the recording heads 14 to be in direct contact with the head holder 20 at the fixing positions of the recording heads 14. As a result, the adjustment of the positions of the recording heads 14 by means of screw fastening can be easily conducted.

As described above, the recording heads 14 are fixed so as to be in direct contact with the head holder 20. In the case where the placement grooves 29 are not defined, therefore, the ink releasing portions 50*c* through which the first ink absorbing member 50 is connected to the second ink absorbing member 52 cannot be placed in a range where the holding portions 14*a* are in contact with the head holder 20. In this case, the size of each ink releasing portion 50*c* is restricted to that of the gap between the two adjacent recording heads 14, and hence the efficiency of movement of ink from the first ink absorbing member 50 to the second ink absorbing member 52 is lowered. By contrast, when, as in the embodiment, the placement grooves 29 are disposed so that the ink releasing portions 50*c* can be placed even between the holding portions 14*a* and the head holder 20 and can be increased in size, the ink discharging efficiency can be enhanced.

If the recording heads 14, or the recording heads 14 and the head holder 20 are closely placed, the ink releasing portions 50*c* cannot be placed. By contrast, when the placement grooves 29 are defined, the ink releasing portions 50*c* can be placed so that the ink absorbed by the first ink absorbing member 50 can be discharged.

Alternatively, the placement grooves 29 may be disposed in the recording heads 14, or in both of the head holder 20 and the recording heads 14. In the embodiment 1, the placement grooves 29 fail to reach the facing surface 20*a*. Alternatively, the placement grooves 29 may be formed so as to penetrate to the facing surface 20*a*.

In the embodiment 1, the ink releasing portions 50*c* are configured so as to discharge ink into the second ink absorbing member 52. Alternatively, the ink releasing portions 50*c* may include a mechanism for directly discharging ink into the waste ink reservoir.

Next, the configuration for removing away ink adhering to the wipers 44 during the wiping operation using the wipers 44 will be described. As shown in FIG. 3, plural inflow holes 27 into which, when the wipers 44 wipe the ejection surfaces 16, ink adhering to the wipers 44 is to flow are defined in the facing surface 20*a* of each head holder 20.

In the second ink absorbing member 52, as shown in FIG. 4, projections 52*a*, which are to enter the inflow holes 27, project from the lower face. The projections 52*a* enter the inflow holes 27 to the same level as the facing surface 20*a* of the head holder 20. Since the projections 52*a* enter the inflow holes 27, it is possible to absorb ink, which enters the inflow holes 27 during the wiping operation.

In the case where the projections 52*a* protrude from the facing surface 20*a*, when the wipers 44 make contact with the projections 52*a*, the wipers 44 are deformed to be separated from the facing surface 20*a*, thereby causing the possibility that the ink adhering to the wipers 44 still remains on the facing surface 20*a*. Therefore, the projections 52*a* preferably enter the inflow holes 27 so long as the projections 52*a* do not protrude from the facing surface 20*a*. In other words, it is preferable that the projections 52*a* are recessed from the facing surface 20*a* or tip ends of the projections 52*a* are in the same level as the facing surface 20*a*.

Part of ink, which remains to adhere to the wipers 44 after an operation of wiping the ejection surfaces 16, flows into the inflow holes 27 and is absorbed by the second ink absorbing member. The other part of the ink is finally absorbed by the third ink absorbing member 26.

Next, the wiping operation of the thus configured ink-jet printer 10 will be described with reference to FIG. 6. FIGS. 6A and 6B are views illustrating the wiping operation.

In the wiping operation, the transport unit 30 is moved so as to be separated from the ejection surfaces 16, thereby forming a space into which the maintenance units 40 are to be inserted. The maintenance units 40 in which the wipers 44 and the comb-like members 46 are disposed are moved toward the ejection surfaces 16.

Figure 6A:
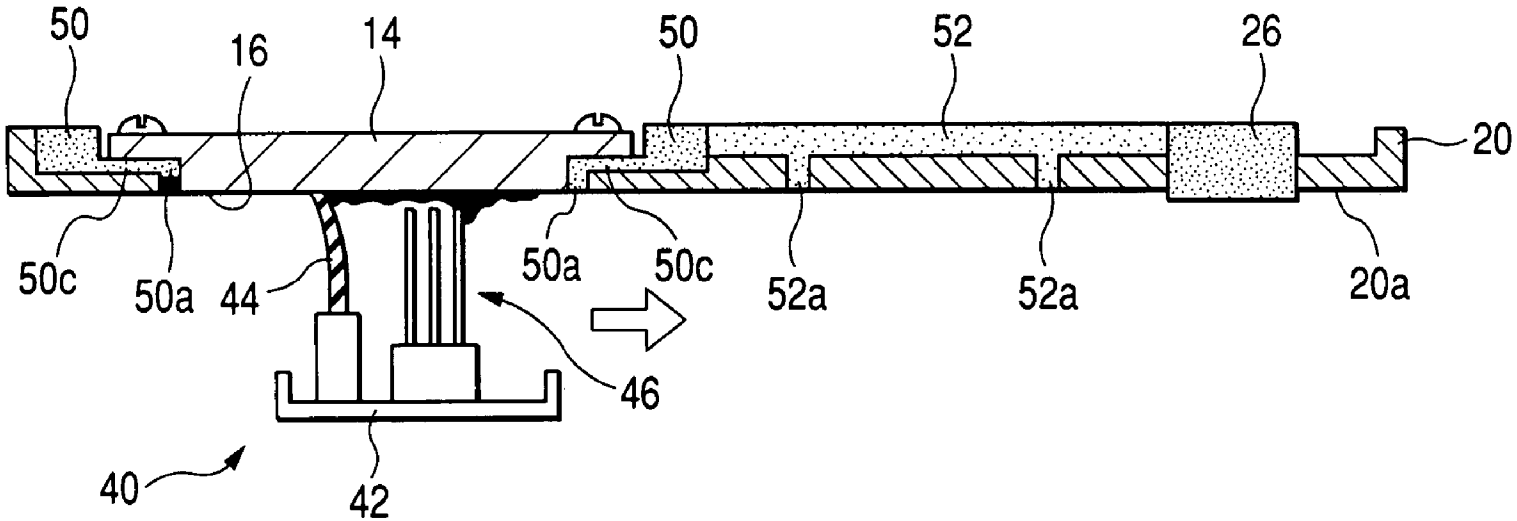
FIG. 6 is a view illustrating a wiping operation.

As shown in FIG. 6A, ink, which previously adheres to the wipers 44, is absorbed by the first ink absorbing portions 50*a* disposed on the upstream side of the recording heads 14 in the wiping direction.

Thereafter, large ink droplets among inks adhering to the ejection surfaces 16 are removed away by the comb-like members 46, and the inks still adhering to the ejection surfaces are wiped away by the wipers 44. At this time, the ink adhering to the wipers 44 may flow into the gaps between the recording heads 14 and the head holder 20. However, such ink is then absorbed by the first and second ink absorbing portions 50*a*, 50*b* (see FIG. 3). The ink absorbed by the first and second ink absorbing portions 50*a*, 50*b* is absorbed through the ink releasing portions 50*c* by the second ink absorbing member 52, and then discharged into the waste ink reservoir.

Figure 6B:
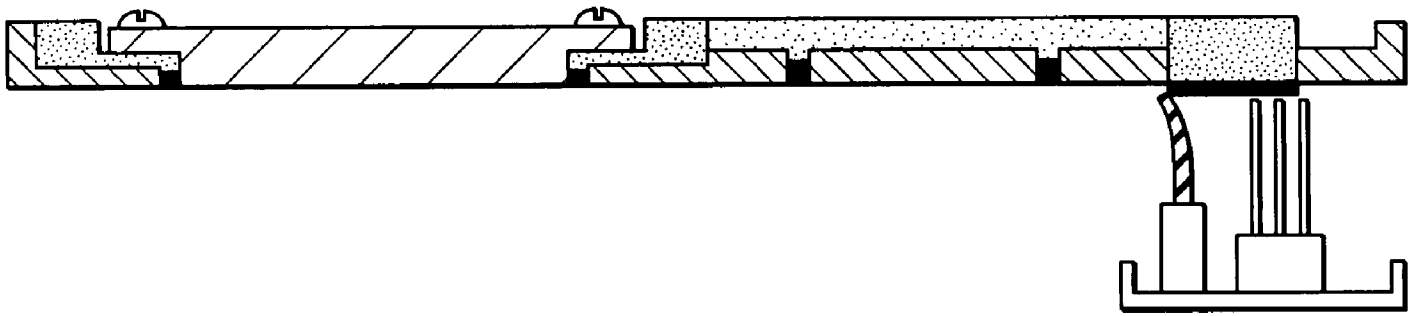

As shown in FIG. 6B, the ink adhering to the wipers 44 is finally absorbed by the third ink absorbing member 26. The ink, which drops down along the wipers 44 and the comb-like members 46 to accumulate on the frame 42 of the maintenance unit 40, is discharged through a tube not shown into the waste ink reservoir.

As described above, in the inkjet printer 10 of the embodiment 1, the members for absorbing ink are disposed in the peripheries of the recording heads 14 to discharge absorbed ink, and hence an ink does not remain in the peripheries of the ejection surfaces 16. Therefore, a phenomenon that ink which is wiped away from the ejection surfaces 16 during the wiping operation drops from the image forming portion 12 on the transport unit 30 to contaminate the transport unit 30 and then the ink is transferred to a sheet does not occur. Thus, the printing quality can be maintained to excellent condition.

Although a preferred embodiment of the invention has been described above, the invention can be adequately modified within the technical scope set forth in claims.

In the embodiment 1, for example, the first ink absorbing member 50 is disposed in the whole range adjacent to the ejection surfaces 16 of the recording heads 14. Alternatively, the first ink absorbing member 50 may be disposed at least on the downstream side of the recording heads 14 in the wiping direction of the wipers 44. This is because the ink adhering to the wiper 44 remains most easily in gaps on the downstream side of the recording heads 14 in the wiping direction, among those between the recording heads 14 and the head holder 20.

In the embodiment 1, the first ink absorbing member 50 and the second ink absorbing member 52 are separately formed. Alternatively, the second ink absorbing member 52 and the first ink absorbing member 50 may be formed of a single member.

In the embodiment 1, the ink releasing portions 50*c* are integrally formed as a part of the first ink absorbing portions 50 and are made of the same material. Alternatively, they may be separately formed.

In the embodiment 1, the placement grooves 29 are disposed in the head holder 20, and the first ink absorbing portions 50 is in contact with the second ink absorbing member 52. Alternatively, the placement grooves 29 may not be disposed.

Embodiment 2

Figure 7:
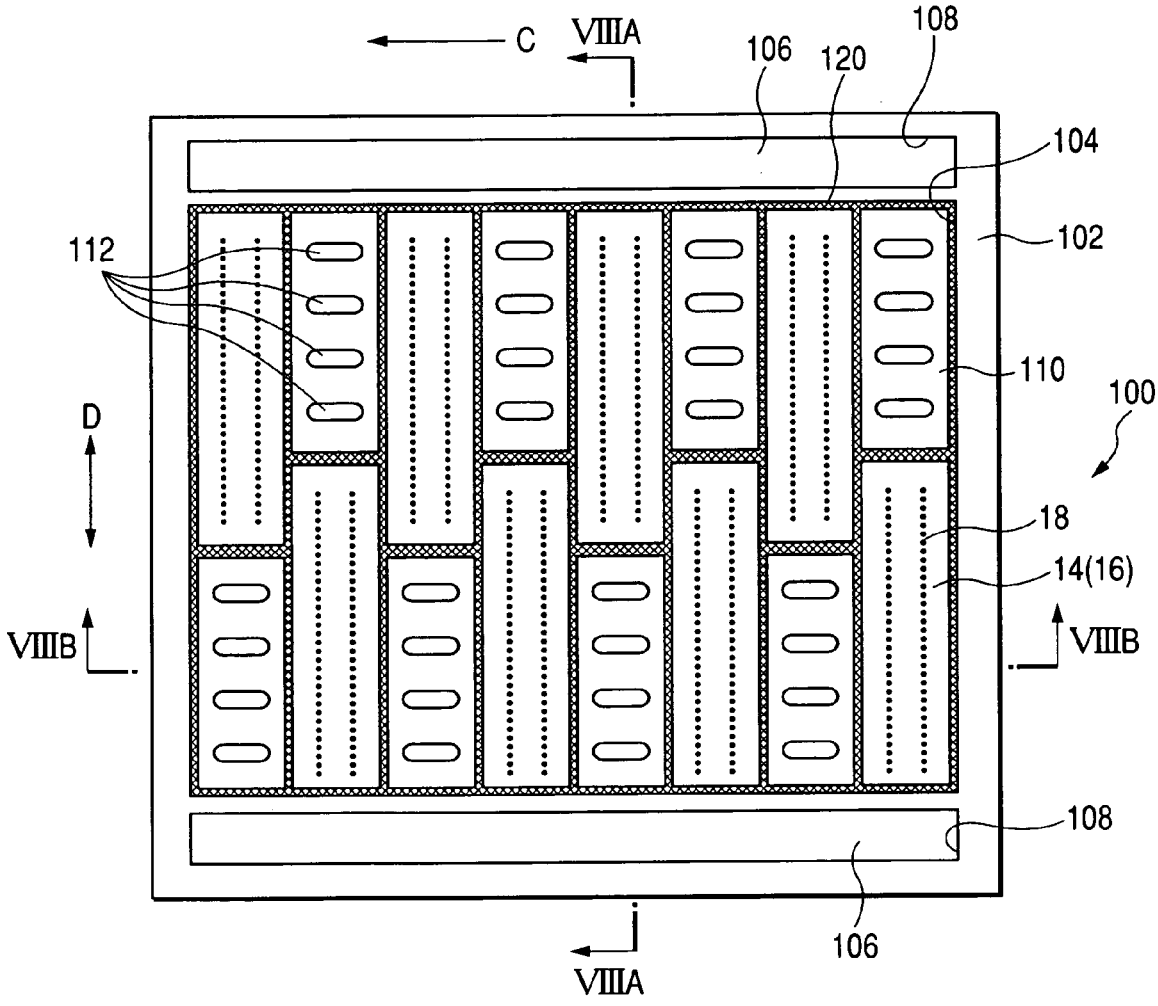
FIG. 7 is a view of an image forming portion 100 in Embodiment 2 as looking from the side of the ejection surfaces 16.
Figure 8A:
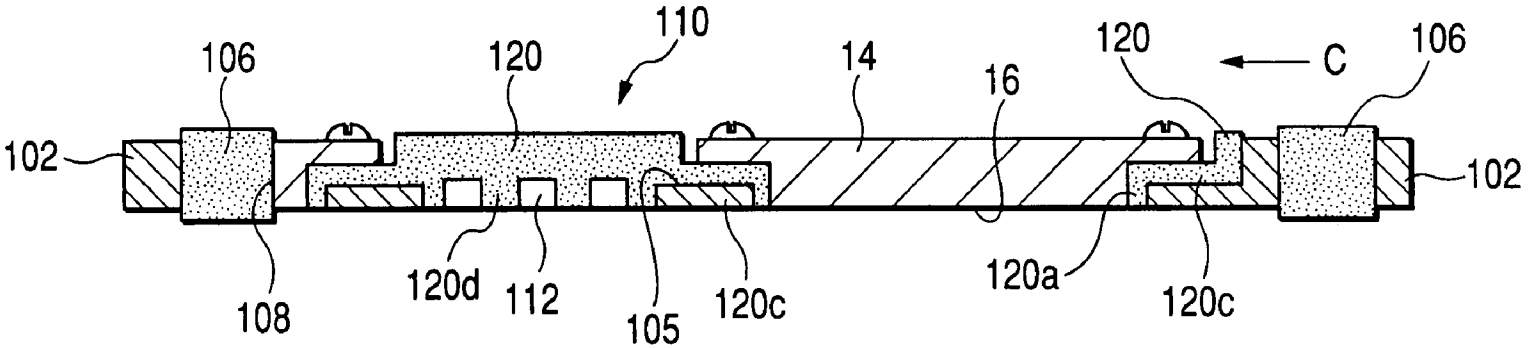
FIG. 8A shows a section view taken along a line VIIIA-VIIIA in FIG. 7.

Hereinafter, a second embodiment of the invention will be described with reference to FIGS. 7 and 8. FIG. 7 is a view of an image forming portion 100 in the embodiment 2 when viewed from the ejection surfaces 16 side. FIG. 8A shows a section view taken along the line VIIIA-VIIIA in FIG. 7, and FIG. 8B shows a section view taken along the line VIIIB-VIIIB in FIG. 7.

In the embodiment 2, the image forming portion 12 of the inkjet printer 10 of the embodiment 1 is replaced with the image forming portion 100, and the other configuration is identical with that of the embodiment 1. In the following description, the components identical with those of Embodiment 1 described above are denoted by the same reference numerals, and their detailed description is often omitted.

As shown in FIG. 7, the image forming portion 100 in Embodiment 2 is configured so that the eight recording heads 14 are attached together with eight spacers 110 to a head holder 102. Openings 104 into which the recording heads 14 and the spacers 110 are to be fitted are defined in the head holder 102. In order to repel an ink, a water repellent process (fluorine coating) is applied to the bottom faces (facing surfaces) of the head holder 102 and the spacers 110.

The recording heads 14 are placed so as to partly overlap with one another when viewed in the medium transporting direction (the direction of the arrow C in FIG. 7). The spacers 110 are placed between the recording heads 14.

As shown in FIG. 8A, the recording heads 14 and the spacers 110 are fixed to the head holder 102 with being screw-coupled to one another. In the head holders 102 and the spacers 110, the facing surfaces, which face the sheet transport path, are designed so as to be positioned in the same level as the ejection surfaces 16. The head holder 102 and the spacers 110 prevent sheet jamming from occurring due to a phenomenon that a sheet transported by the transport unit 30 enters between the recording heads 14. The head holder 102 and the spacers 110 in the embodiment 2 correspond to the head holders 20 functioning as the spacers in the embodiment 1.

As shown in FIG. 7, a sponge member 120 (the first and second ink absorbing members) is fitted into the gaps between the recording heads 14, the spacers 110, and the head holder 102 so as to absorb ink, which flows into the gaps between the recording heads 14, the spacers 110, and the head holder 102 during a wiping operation. In the embodiment 2, the first and second ink absorbing members are formed of the same member as the sponge member 120.

In the sponge member 120, as shown in FIG. 8A, first ink absorbing portions 120*a*, which are inserted into gaps between the recording heads 14 and the spacers 110 (or the head holder 102), are formed on the upstream and downstream sides of the recording heads 14 in the wiping direction. In the sponge member 120, as shown in FIG. 8B, second ink absorbing portions 120*b* and ink releasing portions 120*c* (see FIG. 8A) are also formed. The second ink absorbing portions 120*b* are inserted into gaps between the recording heads 14 adjacent to each other in the medium transporting direction and/or gaps between the recording heads 14 and the spacer 110 (or the head holder 102). The ink releasing portions 120*c* discharge the ink absorbed by the first and second ink absorbing portions 120*a* and 120*b* (see FIG. 8A).

In the head holder 102, defined is a placement hole 108 into which a third ink absorbing member 106 (the third ink absorbing member) for absorbing ink adhering to the wipers 44 after the wiping operation is to be fitted. The third ink absorbing member 106 is fittingly fixed to the placement hole 108 in such a manner that the lower face of the member slightly protrudes from the facing surface.

As shown in FIG. 7, plural inflow holes 112 are defined in the facing surface of each spacer 110. When the wipers 44 wipe the spacers 110, ink adhering to the wipers 44 is to flow into the inflow holes 112. The inflow holes 112 are formed into a groove-like shape elongating in a direction perpendicular to the direction along which the wipers 44 wipe the ejection surfaces 16, so that ink of a larger amount can flow into each inflow hole 112.

Figure 8B:
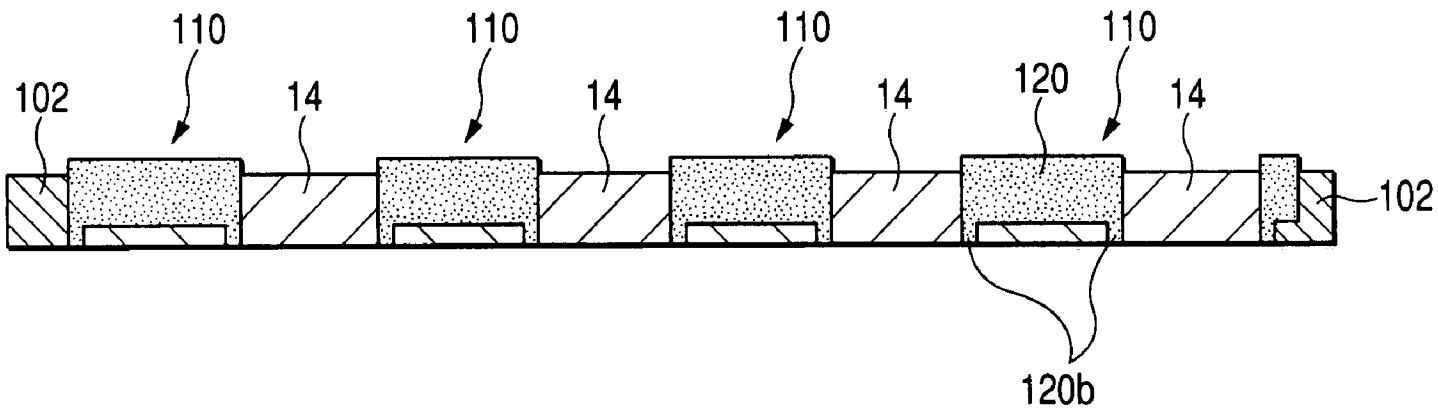
FIG. 8B shows a section view taken along a line VIIIB-VIIIB in FIG. 7

In the spacers 110 side opposite to the facing surfaces, as shown in FIGS. 8A and 8B, the sponge member 120 is placed at a position where the sponge member 120 is in contact with the inflow holes 112 to absorb ink flowing into the inflow holes 112. In the sponge member 120, projections 120*d*, which enter the inflow holes 112, project from the lower face thereof. The projections 120*d* enter the inflow holes 112 to the same level as the bottom faces (facing surfaces) of the spacers 110. Since the projections 120*d* enter the inflow holes 112, it is possible to surely absorb ink, which flows into the inflow holes 112 during the wiping operation.

In the maintenance units 40, the frames 42, the wipers 44, and the comb-like members 46 are disposed so as to correspond respectively to the eight recording heads 14. In the operation in which the maintenance units 40 are reciprocally moved in the width direction during the wiping operation, among the eight frames 42, those for the recording heads 14 on the upstream side of the respective spacers 110 in the movement direction of the maintenance units 40 (the direction of the arrow D in FIG. 7) are raised so that the wipers 44 disposed on these frames 42 are in contact with the ejection surfaces 16. By contrast, when the maintenance units 40 are moved in the opposite direction, these frames 42 are lowered so that the wipers 44*a* disposed on these frames 42 are not in contact with the ejection surfaces 16 and the like. Namely, the eight frames 42 disposed in the maintenance units 40 are configured so that, in one of the forward and return paths of a single reciprocal movement of the maintenance units 40, the frames 42 are raised so that the wipers 44 disposed in the frames 42 make contact with the ejection surfaces 16 of the recording heads 14, the facing surfaces of the spacers 110, and the third ink absorbing member 106 in this sequence.

In the above configuration, when the wipers 44 conduct the wiping operation, ink adhering to the wipers 44 is absorbed by the first and second ink absorbing portions 120*a* and 120*b* of the sponge member 120 disposed in the peripheries of the recording heads 14, and then finally discharged into the waste ink reservoir not shown.

Therefore, ink does not remain in the peripheries of the ejection surfaces 16 after the wiping operation. A phenomenon that ink wiped away from the ejection surfaces 16 during the wiping operation drops from the image forming portion 100 on the transport unit 30 to contaminate the transport unit 30 does not occur. Consequently, it is possible to prevent ink adhering to the transport unit 30 from being transferred to a sheet, and hence the printing quality can be maintained to excellent condition.

Although preferred embodiments of the invention have been described above, the invention is not limited to the described embodiments, and can be adequately modified within the technical scope set forth in the claims.

What is claimed is:

1. An inkjet printer comprising:

a recording head that includes an ejection surface in which a plurality of ejection ports for ejecting ink are defined, wherein the ejection surface faces a medium transport path;

a spacer that is disposed in a periphery of the recording head and includes a facing surface, which faces the medium transport path and an opposite surface opposite to the facing surface;

a wiping member that wipes the ejection surface;

a first ink absorbing member that is disposed in a gap between the ejection surface and the spacer and absorbs ink flowing into the gap between the recording head and the spacer when the wiping member wipes the ejection surface;

an ink releasing member that is connected to the first ink absorbing member and discharges the ink absorbed by the first ink absorbing member from the gap between the ejection surface and the spacer; and a fixing member that fixes the recording head to the spacer at a fixing position, wherein;

at least one of the recording head and the spacer defines a placement groove at a position separate from the fixing position;

the placement groove communicates a position where the first ink absorbing member is disposed with the opposite surface of the spacer; and the ink releasing member is disposed in the placement groove.

2. The inkjet printer according to claim 1, wherein:

the first ink absorbing member is disposed on a downstream side in a wiping direction than the recording head; and the wiping member wipes the ejection surface along the wiping direction.

3. The inkjet printer according to claim 1, wherein the first ink absorbing member is disposed in an entire region of the gap between the recording head and the spacer.

4. The inkjet printer according to claim 1, wherein the first absorbing member includes a surface that faces the medium transport path and is recessed from the ejection surface and the facing surface.

5. The inkjet printer according to claim 1, wherein the first absorbing member includes a surface that faces the medium transport path and has the same height as the ejection surface and the facing surface.

6. The inkjet printer according to claim 1, wherein the ejection surface and the facing surface are at the same height.

7. The inkjet printer according to claim 1, further comprising:

a third ink absorbing member that is disposed on a downstream side in a wiping direction than the ejection surface and absorb ink adhering to the wiping member; and the wiping member wipes the ejection surface along the wiping direction.

8. The inkjet printer according to claim 1, wherein:

the spacer defines an opening portion through which the ejection surface is exposed;

the recording head is fixed to the spacer so that the ejection surface is exposed from the opening portion; and the first ink absorbing member is disposed between the recording head and the opening portion.

9. The inkjet printer according to claim 8, wherein:

the recording head includes a plurality of recording heads; and the opening portion includes a plurality of opening portions so that the plurality of recording heads partially overlap each other when viewed along the medium transport path.

10. The inkjet printer according to claim 1, wherein:

the recording head includes a plurality of recording heads;

the plurality of recording heads are arranged so that the recording heads partially overlap each other when viewed along the medium transport path; and the spacer is disposed between the plurality of recording heads.

11. An inkjet printer comprising:

a recording head that includes an ejection surface in which a plurality of ejection ports for ejecting ink are defined, wherein the ejection surface faces a medium transport path;

a spacer that is disposed in a periphery of the recording head and includes a facing surface, which faces the medium transport path;

a wiping member that wipes the ejection surface;

a first ink absorbing member that is disposed in a gap between the ejection surface and the spacer and absorbs ink flowing into the gap between the recording head and the spacer when the wiping member wipes the ejection surface;

an ink releasing member that is connected to the first ink absorbing member and discharges the ink absorbed by the first ink absorbing member from the gap between the ejection surface and the spacer; and a second ink absorbing member that is disposed on a surface of the spacer opposite to the facing surface and absorbs the ink absorbed by the first ink absorbing member through the ink releasing member.

12. The inkjet printer according to claim 11, wherein:

the ink releasing member is integrally formed with the first ink absorbing member; and the ink releasing member is formed of the same material as the first ink absorbing member.

13. The inkjet printer according to claim 11, wherein:

the spacer defines an inflow hole in the facing surface; and a part of the second ink absorbing member enters the inflow hole of the spacer.

14. The inkjet printer according to claim 13, wherein:

the inflow hole of the spacer communicates the facing surface with a space where the second ink absorbing member is disposed; and when the wiping member wipes the spacer, ink adhering to the wiping member flows into the inflow hole.

15. The inkjet printer according to claim 13, wherein the inflow hole has a groove shape extends in a direction perpendicular to the wiping direction along which the wiping member wipes the ejection surface.

16. The inkjet printer according to claim 13, wherein the inflow hole includes a plurality of inflow holes.

17. The inkjet printer according to claim 13, wherein the part of the second ink absorbing member that enters the inflow hole is recessed from the facing surface.

18. The inkjet printer according to claim 13, wherein:

the part of the second ink absorbing member enters the inflow hole; and a tip end of the part of the second ink absorbing member has the same height as the facing surface.

19. The inkjet printer according to claim 11, wherein:

the first ink absorbing member is disposed on a downstream side in a wiping direction than the recording head; and the wiping member wipes the ejection surface along the wiping direction.

20. The inkjet printer according to claim 11, wherein the first ink absorbing member is disposed in an entire region of the gap between the recording head and the spacer.

21. The inkjet printer according to claim 11, wherein the first absorbing member includes a surface that faces the medium transport path and is recessed from the ejection surface and the facing surface.

22. The inkjet printer according to claim 11, wherein the first absorbing member includes a surface that faces the medium transport path and has the same height as the ejection surface and the facing surface.

23. The inkjet printer according to claim 11, wherein the ejection surface and the facing surface are at the same height.

24. The inkjet printer according to claim 11, further comprising:

a third ink absorbing member that is disposed on a downstream side in a wiping direction than the ejection surface and absorb ink adhering to the wiping member; and the wiping member wipes the ejection surface along the wiping direction.

25. The inkjet printer according to claim 11, wherein:

the spacer defines an opening portion through which the ejection surface is exposed;

the recording head is fixed to the spacer so that the ejection surface is exposed from the opening portion; and the first ink absorbing member is disposed between the recording head and the opening portion.

26. The inkjet printer according to claim 25, wherein:

the recording head includes a plurality of recording heads; and the opening portion includes a plurality of opening portions so that the plurality of recording heads partially overlap each other when viewed along the medium transport path.

27. The inkjet printer according to claim 11, wherein:

the recording head includes a plurality of recording heads;

the plurality of recording heads are arranged so that the recording heads partially overlap each other when viewed along the medium transport path; and the spacer is disposed between the plurality of recording heads.

* * * * *